United States Patent [19]

Schlosser et al.

[11] 4,337,608

[45] Jul. 6, 1982

[54] METHOD AND APPARATUS FOR CLEANING BOTTLE FILLING DEVICES AFTER BOTTLE BREAKAGE

[75] Inventors: Hermann Schlosser, Guldental; Felix Zelder, Münster-Sarmsheim; Rudolf Riedel; Klaus Borberg, both of Bad Kreuznach, all of Fed. Rep. of Germany

[73] Assignee: Seitz-Werke GmbH, Bad Kreuznach, Fed. Rep. of Germany

[21] Appl. No.: 168,771

[22] Filed: Jul. 11, 1980

[30] Foreign Application Priority Data

Jul. 12, 1979 [DE] Fed. Rep. of Germany ..... 2928160

[51] Int. Cl.[3] ..... B65B 3/04; B65B 7/28

[52] U.S. Cl. ..... 53/471; 53/167; 53/282; 134/80; 141/1; 141/90; 141/91

[58] Field of Search ..... 134/78–81, 134/152, 170, 183, 199; 137/238; 141/51, 89–92, 165, 172, 177, 282, 312, 367, 369, 370, 371, 372, 374, 140–143, 156–162, 392, 1; 222/148; 53/471, 167, 282

[56] References Cited

U.S. PATENT DOCUMENTS 4,207,932 6/1980 Gilmour ..... 141/90

*Primary Examiner*—Frederick R. Schmidt

*Attorney, Agent, or Firm*—Becker & Becker, Inc.

[57] ABSTRACT

A method of cleaning bottle filling devices after bottle breakage in filling stations circulating in bottle filling machines, especially counterpressure filling machines. That filling station in which the bottle breakage has occurred is freed of glass fragments by spraying liquid thereagainst, while continuing with the machine rotation and still during the same circulation. At least during the first machine circulation subsequent to the bottle breakage and the liquid spraying, the filling device is rinsed with the liquid supplied to the bottle to be filled. After discharge from the machine circulation, the filled bottle is separated from the filled bottles of the remaining filling stations. The apparatus for carrying out this method includes: a registering and storage unit synchronously connected in steps with the circulation; a sensing device arranged at the filling station circulation path of the filling machine and having sensing elements which are responsive to bottle breakage and which enter a bottle-loss marking or indication into the registering and storage unit; an ejection device, in the region of the discharge element of the filling machine, which upon actuation ejects or separates-out one bottle at a time from the row of bottles leaving the filling machine; and a counting chain of relays is connected to the registering and storing unit for receiving information, and for emitting switching pulses in the feeding or advancing step spacing between the sensing device and the ejection device is connected to a control device which in turn actuates the ejection device.

22 Claims, 2 Drawing Figures

METHOD AND APPARATUS FOR CLEANING BOTTLE FILLING DEVICES AFTER BOTTLE BREAKAGE

Figure 1:
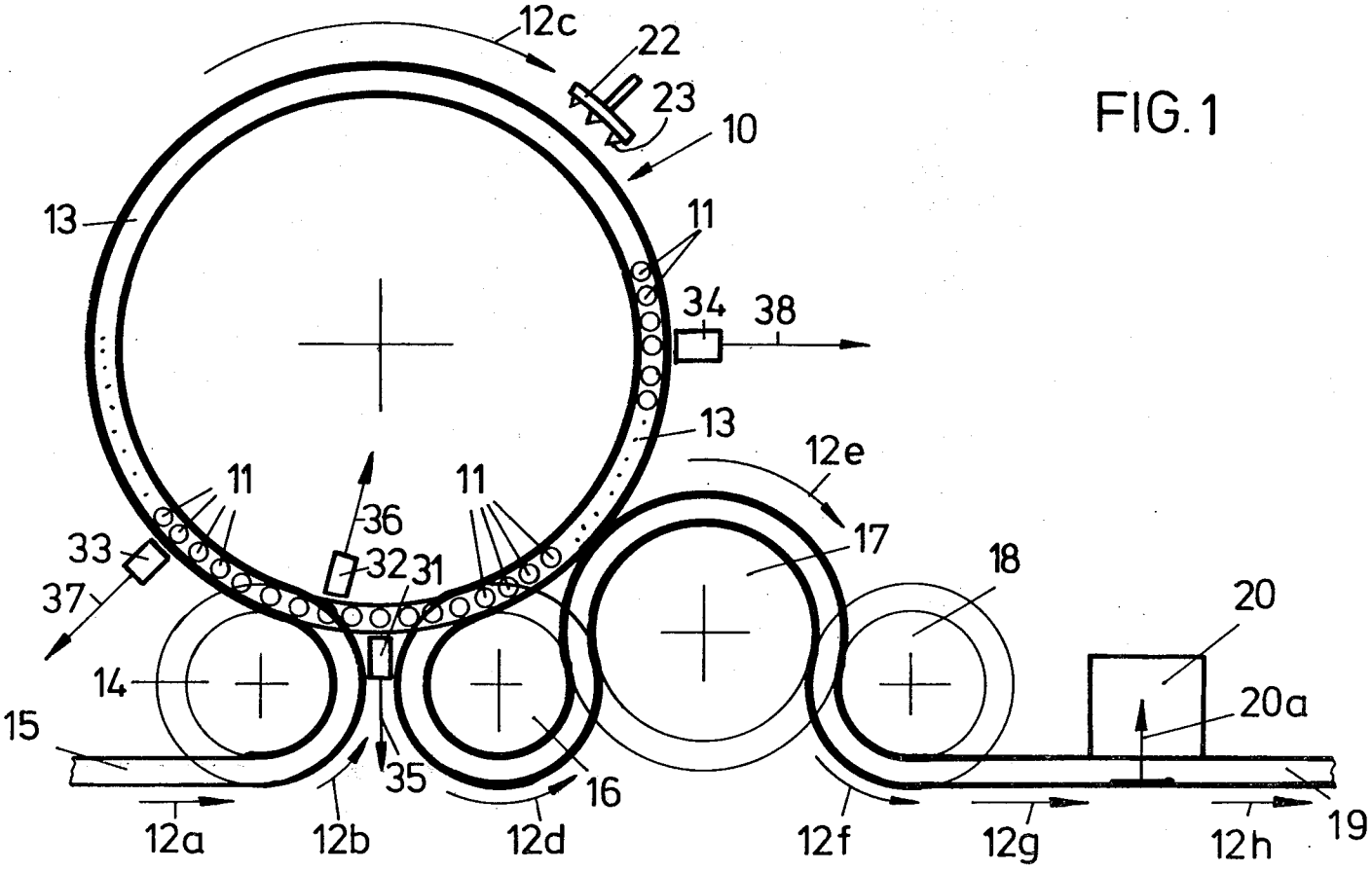

The present invention relates to a method and apparatus for cleaning bottle filling devices after bottle breakage in the filling stations circulating in the filling machines, especially counter-pressure filling machines, according to which that filling station in which the bottle breakage occurred is freed from glass fragments, while continuing with the machine operation and still during the same circulation, by spraying liquid thereagainst.

Methods and apparatus of this type are known in different embodiments. Accordingly, for example in German Pat. No. 926,350, there is described a cleaning device on bottle filling machines, which for the filling stations, essentially comprising a filling valve, a bottle centering means, and a bottle plate or support, of the bottle filling device is arranged at a certain location in the circulatory path of the filling machine and is provided with one or more spray tubes with a plurality of nozzles for the spray liquid and with a control or regulating means for the shut-off valve. With bottle filling machines the filling stations of which are equipped with plates or supports carrying the bottles and being movable up and down, the control means in essence comprises a lever which, in case of a bottle breakage, is actuated by the bottle plate being lifted higher than during normal operation, and which opens the shut-off valve for spraying the filling station with spray liquid.

A similar apparatus is disclosed by German Offenlegungsschrift No. 27 39 742 with which, however, each filling station is equipped with a spray tube of its own. The jets or nozzles installed on the spray tube are so adjusted that the jets of spray liquid are directed respectively against the filling valve, the bottle centering means, and the bottle support of the filling device. The control is basically the same as with the device of German Pat. No. 926,350 and, upon encountering a bottle breakage, is effected by the bottle support being lifted higher than in normal operation. Consequently, the spray tube is pressed upwardly against a rinsing medium supply means and a valve installed therein in order to establish the supply connection for the rinsing liquid and to open the flow to the spray tube.

There is also known a tubular cleaning device for bottle filling devices leading from below against the filling valve, with which the spray liquid is sprayed directly against the filling valve in order to clean its parts effectively (U.S. Pat. No. 2,667,882).

However, practice has shown that all of these known cleaning devices are not sufficient to effectively remove all more or less small glass splinters resulting from a bottle breakage from the sensitive functional parts of the bottle filling device. This is true especially for the filling valve with its parts of more or less complicated shape and its liquid conveying paths, which, even by a spray treatment with cleaning liquid, both from the side and from below, can only be incompletely freed from the more or less small glass splinters. Removal of the fine glass splinters is made even more difficult when bottling sticky liquids, such as juices or sugar-containing beverages, which cause sticking of the fine glass splinters to the parts of the filling valve.

Accordingly, it is an object of the present invention to provide a method and an apparatus with which even the fine glass splinters, which occur during bottle breakage and which penetrate especially into the liquid conveying paths of the bottle filling device, can be removed effectively without having to bring the filling machine to a standstill and without possibly having to remove and intensively clean the parts in that bottle filling device of the filling station in which the bottle breakage occurred.

It is also an object of the present invention to carry out the effective removal of small glass splinters during an uninterrupted operation of the bottle filling machine.

Figure 2:
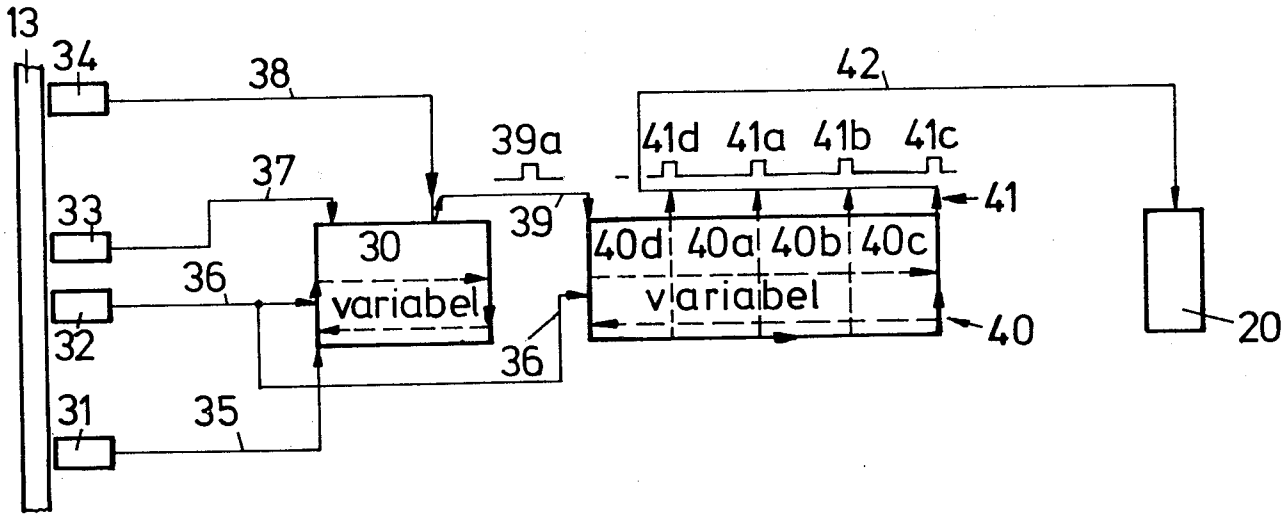

These and other objects and advantages of the present invention will appear more clearly from the following specification in connection with the accompanying drawings, in which:

FIG. 1 is a plan view of a counterpressure bottle filling machine equipped with the apparatus according to the present invention and having a bottle closing device adjoining the circulation path; and FIG. 2 is a block diagram for an inventive apparatus equipped with two counting chains of relays.

The method of the present invention is characterized primarily in that, at least during the first circulatory path of the machine following the bottle breakage and the liquid spraying, the filling device is rinsed with the liquid supplied to the bottle to be filled, and in that the filled bottle, after having been carried out of the machine circulatory path, is separated from the filled bottles of the other filling stations.

The present invention is based upon the recognition confirmed in practice in the meantime that the most effective manner for removal of fine glass splinters from the paths conveying the liquid of the bottle filling device, especially of the filling valve and the parts thereof, comprises utilization of the liquid to be bottled and passing through the filling valve in the normal flow process for effectively rinsing away also small glass splinters from all parts, especially from the liquid conveying paths of the filling valve. For this purpose, already such a quantity of liquid to be bottled which corresponds to one bottle filling can effect a sufficient rinsing of the filling valve and the removal of the small glass splinters.

Tests, however, have shown that, when carrying out this method, it can assumed that by using approximately triple the filling quantity of the bottles to be filled all glass splinters are removed from the filling valve, especially from its liquid conveying paths. Accordingly, a preferred embodiment of the present invention consists therein that the filling device, in which the bottle breakage occurred, is rinsed out with the filling liquid of the bottles to be filled in three sequential circulations occurring subsequent to the circulation during which the bottle breakage occurred, and that the three thus filled bottles of this particular filling device are separated out from the filled bottles of the remaining filling stations.

The inventive method can be carried out in a relatively simple and inexpensive manner without reducing the throughput capacity of bottle filling machines. The liquid contained in the separated out bottles, if such liquid has only little value, can be removed together with the bottles. However, within the framework of the inventive method, it is also possible to recover the liquid, for example by an additional filtering process and return of the liquid into the filling machine. The separated out bottles can be re-used after a bottle rinsing process.

The inventive method can be carried out on smaller filling machines practically without any auxiliary means, so far as the operators or the monitoring personnel at the filling machine can see which bottles are filled in that filling station in which the bottle breakage occurred. An alarm device may in this case be provided to direct the attention of the personnel to the bottle breakage. Both with smaller and also with larger filling machines with closing machines connected thereafter at a more or less great distance, the removal of the bottles filled after the bottle breakage in the first or three subsequent circulations, can be carried out expediently before the closing of the bottles occurs. With combined bottle filling and closing machines this occurs, according to the present inventive teaching, expediently after the closing of the bottles and after discharge out of the machine circulation.

For carrying out the inventive method on larger bottle filling machines equipped with a plurality of filling stations guided in a circulating path, especially counterpressure filling machines, there can be provided an essentially automatic apparatus which is characterized by the following features:

(a) a registering and storage or memory unit synchronously connected in steps with the circulation and having a number of registering locations and storage means corresponding to, or adjustable with respect to, the number of filling stations in the circulation;

(b) a sensing or feeling device arranged at the filling station circulation path of the filling machine and having feeling or sensing elements which are responsive to bottle breakage and which enter a bottle-loss marking into the registering and storage unit;

(c) an ejection device, in the region of the discharge element of the filling machine, which on actuation separates out one bottle at a time from the row of bottles leaving the filling machine;

(d) a counting chain of relays with such a number of counting stations, equipped with storage elements, which equals an integral multiple of the number of filling stations in circulation plus the necessary feeding or advancing steps between the arrangement of the sensing element and the arrangement of the ejection device; and (e) the counting chain of relays is connected to the registering and storing unit for receiving or taking on information; and for emitting switching pulses is, in the feeding or advancing step spacing between sensing device and ejection device, connected to a control device which in turn actuates the ejection device.

By equipping this apparatus with a registering and storage unit for receiving "bottle-loss" information and for feeding this information to a counting chain of relays, as well as with an ejection device controlled by the counting chain of relays, an effective monitoring is assured also with large bottle filling machines, especially counterpressure filling machines, so that upon each occurring bottle breakage there results the subsequent elimination of those bottles which were filled in the particular filling station for rinsing the bottle filling device. This apparatus is also still effective with complete certainty when a bottle breakage occurs relatively often and even when a second bottle breakage occurs in identically the same filling station, and when not even the subsequent elimination of bottles filled in this filling station has been concluded. The technical complexity and the requirements as to space and energy with this apparatus are small in comparison to the monitored bottle filling device. The registering and storage device as well as the counting chain of relays are preferably embodied as electronic counters with storage capacity.

For an especially advantageous embodiment of the present invention, the counting chain of relays is connected to a switching or control device for emitting switching pulses; this switching device has a switching pulse receiver in the same feeding step distance as the number of feeding steps between the sensing element and the ejection device.

If one intends to eliminate three bottles, which have been filled sequentially in the same filling station after occurrence of a bottle breakage, it is recommended that the number of counting and storage stations of the counting chain of relays equal, or be adjustable to, three times the number of filling stations in the circulation path plus the number of feeding steps between the arrangement of the sensing element and the arrangement of the ejection device.

For monitoring the filling stations of the filling machine for a possible bottle breakage, it is of special advantage when the registering and storage unit, which in a preferred embodiment likewise can be embodied as a variable counting chain of relays, in addition to its synchronous running with the circulation of the filling stations, also receives a zero position adjustment relative to the filling stations in the circulation. This means that a respective permanent coordination is maintained between one of the registering and storage stations of the registering and storage device and one of the filling stations. This fixed coordination must thus be checked or reproduced after every interruption of the operation of the filling machine.

Such a permanent coordination can be produced in a simple manner with the inventive machine thereby that the registering and storage device, and possibly also the counting chain of relays which it supplies with the information, are provided with permanent zero position markings, and that before entry of the bottles into the circulation path of the filling machine, there is installed a feeler or sensing element which cooperates with these zero position markings. Such a zero position correlation can be of considerable usefulness for the general monitoring of the bottling machine, for example in order to register a bottle breakage together with the particular filling station in which the bottle breakage occurred. Such information can then be evaluted in order to find out whether possibly any parts of one or another filling station favor or cause such bottle breakage.

The ejection device to be provided with the present inventive apparatus may be arranged in the region of the discharge element of the filling machine, i.e., may eject the bottles in unclosed condition. It is, however, also possible to arrange the ejection device in the region of the discharge element of a bottle closing machine arranged directly following the exit from the filling machine. The latter possibility, especially with combined closing and filling machines—so-called combinations—, offers the advantage that the separated-out or eliminated filled bottles are closed and for this reason can be handled more easily; in addition, the closed bottles are already eliminated from the start as sources of danger.

The ejection device itself may be embodied in a conventional manner and, for example, may be provided with a nozzle for generating a temporary air jet forcing the bottles to be separated out to the side. One ejection device usable with the inventive apparatus is shown for example in FIG. 8 of German Offenlegungsschrift No. 1,782,811.

Another possible embodiment of the ejection device comprises a conveying star or turntable driven for rotational movement, and, on the discharge side of the conveying star at least two separate bottle guiding paths, while in the conveying star recesses there are arranged suction devices temporarily actuable by vacuum for the bottles to be separated out. Such an ejection or separating-out device, in contrast to FIG. 8 of German Offenlegungsschrift No. 1,782,811, retains a bottle to be separated for a longer time in the respective recess of the conveying star than would be the case in the normal operation of the conveying star. Consequently, the bottle retained in the respective recess of the conveying star or turntable is circulated still further until it comes to a second conveying path extending parallel to the normal conveying path.

A further possibility for the embodiment of the ejection device to be provided in the inventive apparatus consists therein that the apparatus is equipped with a cylinder-piston arrangement to push the bottles to be separated out laterally out of the row of bottles. An example of such an ejection device usable with the present inventive apparatus is shown in FIG. 1 of German Offenlegungsschrift No. 1,782,811.

The ejection device, however, can also be embodied as a flow-diverter with a plurality of laterally adjustable lateral guiding elements for the bottles leaving the filling machine. This embodiment makes possible a very gentle lateral displacement and ejection of the bottles to be separated out and also recommends itself particularly in such situations in which the bottles are to be separated out in open condition.

Referring now to the drawings in detail, and FIG. 1 thereof in particular, the bottle filling machine 10 illustrated therein is equipped with a plurality of filling stations 11 which are guided in a circulation path 13 in the direction of the arrow 12*c*. The empty bottles supplied by a conveying or transporting device 15 by way of an inlet star or turntable 14 are respectively consecutively introduced into a filling station 11; the empty bottles are guided over a circulation path 13 while remaining in the particular filling station 11 until they reach a discharge star or turntable 16, which is followed by a bottle closing machine 17 with bottle circulation, a discharge star or turntable 18, and a discharge path or conveyor 19 for transporting away the bottles. A schematically illustrated ejection or discharge device 20 is arranged at the discharge path 19 and can have any suitable arrangement and embodiment. The transporting direction or path of the bottles is indicated in FIG. 1 by the arrows 12*a*, 12*b*, 12*c*, 12*d*, 12*e*, 12*f*, 12*g*, and 12*h*, while the ejection of the separated out bottles occurs in the direction of arrow 20*a*.

The special arrangement of the filling machine 10, the closing machine 17, and the ejection device 20 can be made in any suitable and known manner. Essential for the present invention is the fact that the filling machine 10 is equipped with a plurality of filling stations 11 continuously circulating in a circulating path 13; each of these filling stations 11 is adapted to receive a bottle to be filled, and this sequence of bottles determined by the filling stations 11 is also maintained through the discharge turntable 16, the closing machine 17, the discharge turntable 18 thereof, and the transporting path 19 up to the ejection device 20. If any gaps arise during the feeding of bottles to the filling stations 11, for instance by leaving free one or another filling station 11, at the inlet turntable 14, or due to bottle breakage in one or another filling station 11, these gaps also remain as far as to the ejection device 20.

Furthermore, a spraying device 22 for treatment of the filling stations 11 with pressurized water is stationarily arranged in the region of the circulation path 13 of the filling machine 10 in which the bottles to be filled are subjected to pressurized gas. The spraying device 22 expediently comprises several nozzles 23 arranged on one or more spray tubes, and also comprises a control means which temporarily releases spray jets when a bottle breakage occurs. These spray jets are in essence directed against the filling valve, the bottle centering means, and the bottle plate or support so as to remove any pieces of glass and glass splinters from these components. The spraying device 22 can, as to embodiment, manner of control, and function, correspond extensively to the previously mentioned spraying device disclosed by German Pat. No. 926350.

Also the ejection device 20 can be embodied in differing manner. Examples of such an ejection device 20 are shown in FIGS. 1 and 8 of German Offenlegungsschrift No. 17 82 811. In this earlier example, there is provided a controllable cylinder-piston unit which is arranged laterally on the conveyor path 19 for transporting away the bottles. This cylinder-piston unit, upon receiving a signal, bumps the bottle located in front of it in the direction of the arrow 20*a* out of the path 19, for example onto a collecting table. The ejection device 20 can also be embodied in the manner of a flow diverter, which likewise is controllable by a signal and, upon receiving a signal, guides a bottle located in its range into a separate conveying path for transporting away such bottle; this path can, for example, extend parallel to the path 19. Other possibilities exist therein that the ejection device is equipped with a transporting star or turntable as shown in FIG. 8 of German Offenlegungsschrift No. 17 82 811. Such an ejection device can be combined with the discharge star or turntable 18. Also, an ejection device of this type could be combined with a discharge star or turntable 16 arranged at the exit from the circulation path 13 in order in this manner to eject the filled bottles to be separated out already before they reach the closing machine 17. Provision of an ejection device is also conceivable which has been changed with respect to the device of FIG. 8 of German Offenlegungsschrift No. 17 82 811 in that the ejection turntable 18 or 16 has associated therewith a suction-nozzle arrangement; this suction-nozzle arrangement, upon actuation thereof, retains a bottle for a longer time in a recess of the turntable 18 or 16 than is the case in normal operation; consequently, the bottle is taken along still further and is delivered to a separate conveying path for transporting away bottles. Such a separate conveying path can extend parallel to the conveying path 19, or can be located behind the inlet to the closing machine 17.

The ejection device 20 has a registering and storage unit or memory 30 associated therewith which is embodied as a counting chain of relays of variable length, in order to be able to adapt the number of registering and storage locations contained therein to the number of filling stations 11 in the circulation path 13. Additionally, the counting chain or relays is capable of being advanced or switched stepwise in synchronism with the filling stations 11 in the circulation path 13 of the filling machine 10.

The registering and storage unit 30 is connected with a feeler or sensing device which is provided with several feelers or sensing elements distributed over the path 13 of the filling machine 10. Of these elements, a zero position sensing element 31 is arranged with a connection 35 to the registering and storage unit 30 (FIG. 2) at a zero position of the path 13 provided ahead of the inlet location of the bottles. A synchronous sensing element 32 is likewise arranged ahead of the bottle inlet into the path 13, though, viewed in circulating direction 12*c*, after the zero position sensing element 31. The synchronous sensing element 32 is connected by a line 36 with the registering and storage unit 30 and with a control counting chain of relays 40 which is connected to the registering and storage device 30. Both the counting chain of relays of the registering and storage unit 30, and also the control counting chain of relays 40, expediently comprise electronic counters with storage capacity and are synchronously advanced or switched further stepwise with the movement of the filling stations 11 in the path 13.

For detecting bottle breakage, the sensing device additionally provides an advance control signal sensing element 33 arranged in the bottle inlet region of the path 13 and a control sensing element 34. The control sensing element 34 is arranged in that region of the path 13 which follows the region in which the bottles to be filled are subjected to pressurized gas. The advance control signal sensing element 33, by a line 37, and the control sensing element 34, by a line 38, are connected with the registering and storage device 30, from which a signal transfer line 39 for the signals indicated at 39*a* leads to the control counting chain of relays 40.

The control counting chain of relays 40 is embodied with variable length. But in the number of its components and storage capacity, it is to be adapted to three times the number of filling stations 11 participating in the circulation path 13 of the filling machine 10 (normal segments 40*a*, 40*b*, 40*c*), increased by the number of necessary feeding or advancing steps between the arrangement of the control sensing element 34 and the arrangement of the ejection device 20 (additional or auxiliary section 40*d*). The control counting chain of relays 40 is switched or advanced stepwise, by way of the connection 36, by the synchronous-cycle sensing element 32 synchronously with the circulation path 13 of the filling machine and synchronously with the counting chain of relays of the registering and storage device 30. A signal 39*a* supplied from the registering and storage unit 30 by way of the signal transfer line 39 is then stored in the control counting chain of relays 40, and is repeatedly delivered to a signal delivery device 41, as set forth in the following description. These signals 41*d*, 41*a*, 41*b*, and 41*c* are then delivered by way of a control line 42 to the actuating device of the ejection or discharge device 20.

Both the counting chain of relays of the registering and storage device 30, and also the control counting chain of relays 40, aside from the aforementioned matching or adaptation of their registering and storage locations or counting and storage locations, are circulated counter to each other in the respective direction of the arrow, and are provided with a clearing or erasing device for the storage or memory, which is arranged directly between the end and the beginning of the bottle circulation.

The manner of operation of the apparatus is as follows: The counting chain of relays of the registering and storage device 30 is set to "0" by means of the zero-position sensing element 31, before the bottle filling occurs, when a filling station "0" passes the zero-position sensing element 31 in the path 13. Accordingly, not only the stepwise feeding movement of the counting chain of relays in the registering and storage device 30 is synchronized with the circulating movement of the filling stations 11, but also a common zero-position is established, so that each registering and storage location of this counting chain of relays in the registering and storage device 30 is permanently coordinated with a particular filling station 11 in the circulation path 13 of the filling machine 10.

The synchronous movement of the counting chain of relays in the registering and storage device 30 and of the control counting chain of relays 40 with the circulation of the filling stations 11 in the filling machine 10 is assured in the following manner. The synchronous-cycle sensing element 32 generates a counting-cycle signal each time a filling station 11 passes by and accordingly, by way of the connection 36, seizes the feeding devices of the registering and storage unit 30 and of the control counting chain of relays 40; also, the advance control sensing element 33 for each filling station 11 passing by and occupied by a bottle generates a feeding signal, and this feeding signal generated by element 33 is transmitted by way of the connection 37 to the registering and storage unit 30; and furthermore, the control element 34 generates a control signal for each filling station 11 passing by and occupied by a bottle, and this control signal is, by the connection 38, given off to the registering and storage device 30 for release of the feeding signal stored in the counting chain of relays for the respective filling station 11. Consequently, each filling station 11 is associated with or defined by a continuous or successive number in the counting chain or relays of the registering and storage device 30 and also with a marking, when it is occupied by a bottle at the bottle inlet. The filling station number and the "occupied" marking are advanced by one position with each cycle of the synchronous-cycle sensing element 32, and reach the inlet location of the connection 38 from the control feeler 34. If the bottle is still there when its filling station 11 passes the control sensing element 34, the "occupied" marking for this particular filling station 11 is cancelled by the generated control signal.

If, in contrast, the filling station is without a bottle, when it passes the control sensing element 34, as a consequence of bottle breakage and consequent effective spraying of the spray device 22 for eleminating any glass residues from this filling station 11, then a signal 39*a* is given by the registering and storage device 30 by way of the connection 39 to the synchronous following control counter chain of relays 40, and thereafter the "occupied" marking is cancelled. The signal 39*a* is so stored in the control counting chain of relays 40 that the "occupied" markings 41*d*, 41*a*, 41*b*, 41*c* simultaneously are available as control signals which are first guided through the additional or auxiliary section 40*d* with the synchronous stepwise advance of the control counting chain of relays 30; the cycle steps of auxiliary section 40*d* correspond to the advancing steps of a particular bottle on the transporting path from the control sensing element 34 to the ejection device 20. This means that a first actuation of the ejection device 20 occurs when the gap in the transported row of bottles resulting from a bottle breakage comes into the range of the ejection device 20. During further operation, the signal 41*a* stored in the control counting chain of relays 40 is transmitted or guided synchronously to the movement of the counting chain of relays in the registering and storage device 30 and with the circulating movement of the filling stations 11 through the normal section 40*a*, where at the end of this section 40*a* there occurs a signal take-off and a control signal 41*a* for actuation of the ejection device 20. At this point of time, due to the reciprocal synchronization, there is located before the ejection device 20 just that bottle which in the first circulation following the bottle breakage has been filled in the particular filling station 11 in which the bottle breakage occurred, and which contains the filling liquid with which the filling device of this filling station 11 was rinsed according to the method of the present invention. This filled and closed bottle is separated out by actuation of the ejection device 20.

During the further operational sequence, the control counting chain of relays passes through the normal section 40*b* with its storage location containing the signal 41*b*; the number of steps of section 40*b* also equals the number of filling stations 11 in the circulation path 13 of the filling machine 10. When, upon reaching this normal section 40*b*, again a control signal is given off to the actuating device of the ejection device 20, there is located before the ejection device 20 the bottle filled in the corresponding filling station 11 in the second circulation following the bottle breakage, and this bottle is then likewise ejected. The same procedure is carried out once again by means of the normal section 40*c* for ejecting bottles filled in the respective filling station 11 in the third circulation following the bottle breakage, and thereafter each control signal 41*d*, 41*a*, 41*b*, 41*c*, detected at the ejection device 20 and transferred to the ejection device 20, is cancelled from the control counting chain of relays 40. The control counting chain of relays is consequently ready for receiving new signals and runs into the feeding position, in other words to the connection location of the signal transfer line 39, because of the aforementioned adaptation of the number of its counting and storage locations with the cancelled storage locations.

If a filling station 11 is not occupied from the beginning with a bottle, the feeding sensing element 33 generates no signal. In contrast, the signal generated by the control sensing element 34 is delivered to the registering device 30, though not to the control counting chain of relays 40.

If desired, also a different number of bottles can be separated out or ejected. For this purpose, the control counting chain of relays 40 with the number of its normal sections 40*a*, 40*b*, 40*c* needs only be adapted or set as to the number of bottles to be separated out. Only the number of feeding or advance steps in the auxiliary or additional section 40*d* is to be set or adapted correspondingly, upon change of position of the ejection device 20 on the means 19 for transporting away the bottles, by reduction or increase of the distance for arranging the control sensing element 34 at the circulation path 13 of the filling machine 10.

The manner of operation of the apparatus is independent of the speed of the machine. The manner of operation of the apparatus also is not influenced if during the operation just described there should occur a bottle breakage in one or another or even the same filling station 11.

The present invention is, of course, in no way restricted to the specific disclosure of the specification and drawings, but also encompasses any modifications within the scope of the appended claims.

What we claim is:

1. A method of cleaning bottle-filling device including filling elements defining a liquid conveying path having fine glass splinters and fragments therein inaccessible to an external spray after bottle breakage occurring occasionally in filling stations circulating in bottle filling machines, especially counterpressure filling machines, said method including the steps of:

spraying liquid for a thorough and basic interior cleaning of the liquid conveying path with the filling elements as well as against that filling station in which the bottle breakage occurred, also to free said last mentioned filling station of glass splinters and fragments, while continuing with the filling machine circulation and still during the same circulation during which breakage occurred;

rinsing the pertaining filling device, with the liquid supplied to the bottle to be filled, at least during the first machine circulation following the circulation during which said bottle breakage and liquid spraying took place, a bottle being filled, as a result of said rinsing, during each circulation during which said rinsing occurs;

discharging from said filling machine the bottles filled during said rinsing; and separating-out the bottle filled during said rinsing of the filling device and the interior cleaning of the liquid conveying path, said bottle being taken from the unbroken bottles filled at the remaining filling stations where no breakage occurred during the circulation prior to said circulation during which breakage occurred.

2. A method according to claim 1, which includes repeating said rinsing and separating-out steps for the three consecutive machine circulations following the circulation during which said bottle breakage and liquid spraying took place.

3. A method according to claim 1, in which said bottles filled during said rinsing step are closed or capped prior to said separating-out step.

4. An apparatus for cleaning bottle-filling devices of filling stations including filling elements defining a liquid conveying path having fine glass fragments and splinters therein inaccessible to an external spray after bottle breakage in a bottle filling machine, especially in counterpressure filling machines, having a plurality of filling stations guided in a circulation path therein, said apparatus comprising:

a registering and storage or memory unit synchronously connected in steps with said circulation path and being provided with a number of registering and storage elements at least adjustable to the number of filling stations in said circulation;

a sensing unit associated with said filling station circulation path and including a first and second sensing element, said sensing elements being responsive to bottle breakage and being provided to enter a bottle-loss marking into said registering and memory unit;

means for rinsing the pertaining filling device for a thorough and basic interior cleaning of the liquid conveying path including the filling elements, as well as the filling station being rinsed with the liquid supplied to the bottle to be filled used for interior and external removal of glass fragments and splinters;

a discharge device for receiving bottles from said filling machine;

an ejection device, located in the region of said discharge device, which upon actuation separates out a bottle filled during the rinsing of the filling device and the interior cleaning of the liquid conveying path, said bottle being taken from the row of previously unbroken filled bottles leaving said filling machine;

a counting chain of relays having a number of counting stations, equipped with storage elements, equaling an integral multiple of the number of filling stations in said circulation plus the necessary advancing steps between said second sensing element and said ejection device, said counting chain of relays being connected to said registering and storage unit for receiving information; and a control device operatively associated therewith, said counting chain of relays, in the advancing step spacing between said sensing unit and said ejection device, being connected to said control device for emitting switching pulses, said control device in turn being provided to actuate said ejection device.

5. An apparatus according to claim 4, in which said control device is provided with a control pulse receiver in the same advancing step distance as the number of advancing steps between said second sensing element and said ejection device.

6. An apparatus according to claim 5, in which the number of counting stations and storage elements of said counting chain of relays equals three times the number of filling stations in said circulation path plus the number of advancing steps between said second sensing element and said ejection device.

7. An apparatus according to claim 5, in which the number of counting stations and storage elements of said counting chain of relays is at least adjustable to the value equalling three times the number of filling stations in said circulation path plus the number of advancing steps between said second sensing element and said ejection device.

8. An apparatus according to claim 7, in which said registering and storage unit and said first and said second sensing elements are embodied in such a way that a marking is placed in the appropriate registering and storage element for each filling station occupied by a bottle and passing said first sensing element, and that this marking is again erased by said second sensing element upon sensing said bottle in the same filling station.

9. An apparatus according to claim 7, in which both said first and second sensing elements are located in said circulation path, said first sensing element being located in the inlet region of said filling machine, and said second sensing element being located subsequent thereto.

10. An apparatus according to claim 9, which includes means for subjecting bottles to pressurized gas, said second sensing element being located subsequent to said last mentioned means.

11. An apparatus according to claim 10, in which said registering and storage unit is provided with an erasing device for said marking located on said counting chain of relays after said information receiving station.

12. An apparatus according to claim 11, in which said registering and storage unit is embodied as an endless circulating counting chain of relays.

13. An apparatus according to claim 12, in which said counting chain of relays is adapted to actuate said switching pulse receiving control device and is embodied in an endless circulating manner, said counting chain of relays being provided with an erasing device after said control device for all information received by it.

14. An apparatus according to claim 13, in which said registering and storage unit and said counting chain of relays are embodied as electronic counters having storage capacity.

15. An apparatus according to claim 14, in which at least said registering and storage unit is provided with permanent zero position markings, and which includes a third sensing element arranged prior to entry of bottles into said circulation path of said filling machine and cooperating with said zero position markings.

16. An apparatus according to claim 15, which includes a fourth sensing element located after said third sensing element in said circulation path prior to entry of said bottles, said fourth sensing element, for each filling station, generating a counting pulse signal for said registering and storage unit and for said counting chain of relays.

17. An apparatus according to claim 16, in which said ejection device is provided with a nozzle for generating a temporary air jet for forcing the bottles to be separated-out to the side.

18. An apparatus according to claim 16, in which said ejection device is provided with a cylinder-piston arrangement for pushing bottles to be separated-out laterally out of the row of bottles.

19. An apparatus according to claim 16, in which said ejection device is embodied as a flow diverter having a plurality of laterally adjustable side guide elements for the bottles leaving said filling machine.

20. An apparatus according to claim 16, in which said ejection device is provided with a conveying turntable, with recesses, for rotational movement, with at least two separate bottle guiding paths being provided on the discharge side of said turntable, and suction devices for the bottles to be separated being provided in said turntable recesses and being temporarily actuatable by vacuum.

21. An apparatus according to claim 20, in which said ejection device is arranged in the region of said discharge device of said filling machine.

22. An apparatus according to claim 20, in which said discharge device for receiving bottles from said filling machine is connected directly to a bottle closing machine which is provided with a discharge member, said ejection device being arranged in the vicinity of this discharge member.

* * * * *